US005354219A

United States Patent [19]

Wanjura

[11] Patent Number: 5,354,219

[45] Date of Patent: Oct. 11, 1994

[54] MULTIPOLAR SCREENED CONNECTOR HAVING A COMMON EARTH

[75] Inventor: Gunter Wanjura, Kungsängen, Sweden

[73] Assignee: Vemako AB, Kungsangen, Sweden

[21] Appl. No.: 75,584

[22] PCT Filed: Dec. 5, 1991

[86] PCT No.: PCT/SE91/00835

§ 371 Date: Jun. 15, 1993

§ 102(e) Date: Jun. 15, 1993

[87] PCT Pub. No.: WO92/11671

PCT Pub. Date: Jul. 9, 1992

[30] Foreign Application Priority Data

Dec. 21, 1990 [SE] Sweden ..... 90041252

[51] Int. Cl.[5] ..... H01R 13/648

[52] U.S. Cl. ..... 439/608; 439/701; 439/79

[58] Field of Search ..... 439/79, 80, 95–98, 439/108, 607, 608, 701, 936

[56] References Cited

U.S. PATENT DOCUMENTS 4,193,654 3/1980 Hughes et al. .
4,210,376 7/1980 Hughes et al. .
4,975,084 12/1990 Fedder et al. ..... 439/108 X
5,009,616 4/1991 Fogg et al. ..... 439/608
5,169,343 12/1992 Andrews ..... 439/608
5,261,829 11/1993 Fusselman et al. ..... 439/608 X

FOREIGN PATENT DOCUMENTS 0107288 5/1984 European Pat. Off. .
0337634 10/1989 European Pat. Off. .
WO87/07441 12/1987 World Int. Prop. O. .

*Primary Examiner*—Khiem Nguyen
*Attorney, Agent, or Firm*—Burns, Doane, Swecker & Mathis

[57] ABSTRACT

A multipolar, screened connector having a common earth and comprising a male part (1) and a female part (2), wherein the male part comprises a body (4) which is made from an electrically insulating material and which has parts (6) which are adapted to the female part and surround the female part at least partially, and wherein the body includes rows and columns of connector pins (7) which extend through the base part (5) of the body parallel with the surrounding parts (6), and wherein the female part includes a body (9) which is made from an electrically insulating material and which is intended for insertion between the surrounding parts of the body of the male part and which is provided with hole parts (18) which are adapted to the pins of the male part, and channels intended for contact lines (16) which extend from the hole parts to contact devices (15) connecting the pins. According to the invention, the body (9) of the female part (2) is constructed from a plurality of plates (10, 11) having a pitch which corresponds to the columns of pins (7); in that each of the mutually facing sides of the plates is provided with a recess (12) which forms half of the hole parts (18) corresponding to a column of pins and the channels for the contact lines (15).

20 Claims, 8 Drawing Sheets

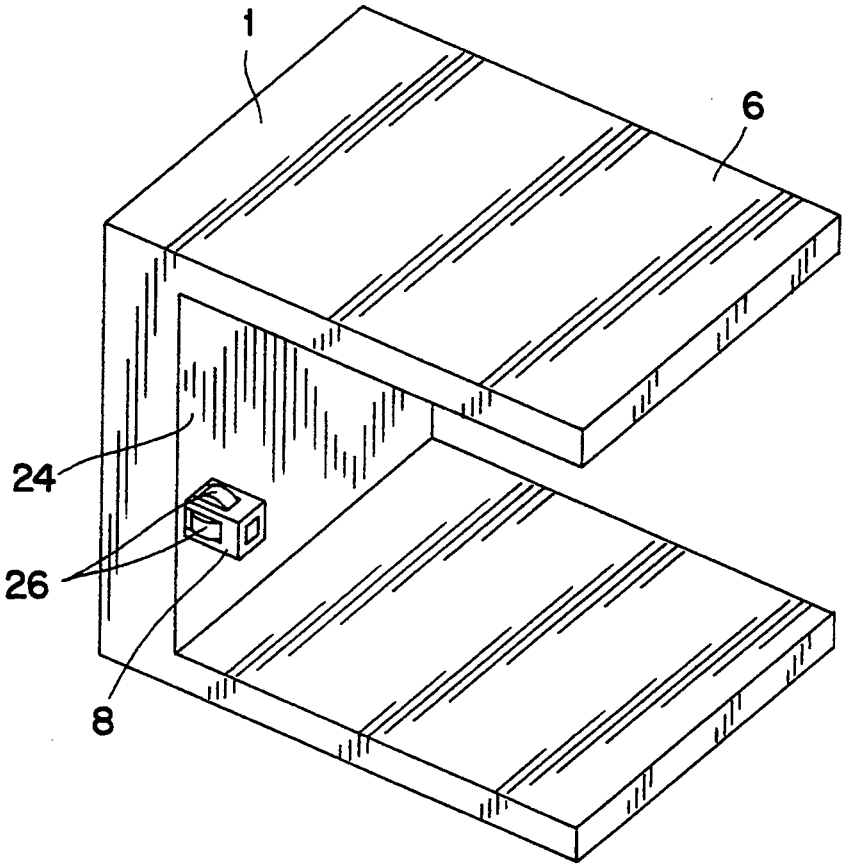
Fig. 10
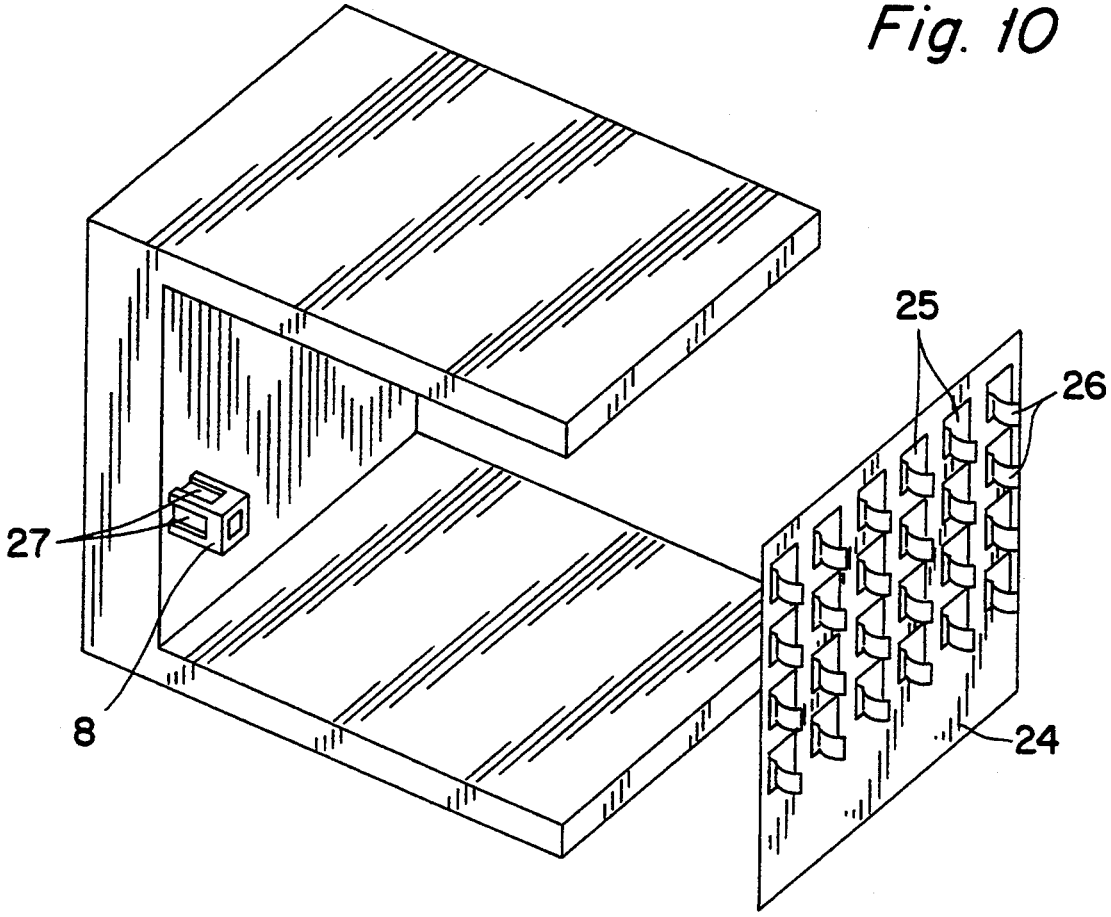

MULTIPOLAR SCREENED CONNECTOR HAVING A COMMON EARTH

TECHNICAL FIELD

The present invention relates to a multipolar, screened connector having a common earth and comprising a male part and a female part, wherein the male part includes a body manufactured from an electrically insulating material and having parts which are adapted to the female part and which at least partially surround said part, and further comprising rows and columns of connector pins which extend through the base part of the body parallel with said surrounding parts, and wherein the female part includes a body which is manufactured from an electrically insulating material and which is adapted for insertion between the surrounding parts on the male-part body and is provided with hole-parts into which the pins on the male-part fit and from which channels extend for the accommodation of contact lines or conductors extending from contact devices to said pins.

BACKGROUND ART

Screened, multipolar connectors of this kind are known to the art. The screen is constructed from metal plates which are inserted in slots in the female-part body between the rows of holes and connection-line channels. The plates are also coated with an insulating material, in some cases. The plates are mutually connected electrically and to earthing means, such as to form a screen around the female part. The drawback with constructions of this kind is that they include a relatively large number of separate components which render the task of assembling the connector both complicated and time-consuming. Furthermore, the screen on the female part does not extend fully around said part and is totally lacking on the male part. Consequently, signals that are transmitted via these connectors are liable to be subjected to disturbances, particularly in the case of high frequency signals.

In the case of another earlier known constructions, the female part comprises a plurality of screening metal-plate profiles which are coated with insulating material. Electrical contact devices and contact lines are disposed between the plates and the profiles. This construction is also relatively complicated as is also the task of assembling the connector. This connector also lacks a fully encircling screen, and the male part also lacks the provision of a screen.

Fully screened devices, in the form of coax-devices, however, are known to the art. These devices, however, have only one conductor, i.e. they are unipolar.

DISCLOSURE OF THE INVENTION

The object of the present invention is to avoid the drawbacks associated with earlier constructions of connectors of the aforesaid kind and to provide a multipolar connector which has the same good screening properties as a coax-device, which has a simple and purposeful construction, which can be readily assembled, and which is fully screened around both the female part and the male part of said connector. This object is achieved with the connector having the characteristic features set forth in the following claims.

A screened connector constructed in accordance with the invention affords primarily the advantage of being totally screened, both with respect to the male part and the female part, and makes possible the disturbance-free transmission of high frequency signals. Furthermore, the connector can be manufactured and assembled in a simple manner, because it comprises only a few components.

The invention will now be described in more detail with reference to a preferred exemplifying embodiment thereof and also with reference to the accompanying drawings.

BRIEF DESCRIPTION OF THE DRAWINGS

FIG. 10 illustrates the construction of a component part of the male connector-part.

BEST MODE OF CARRYING OUT THE INVENTION

Figure 1:
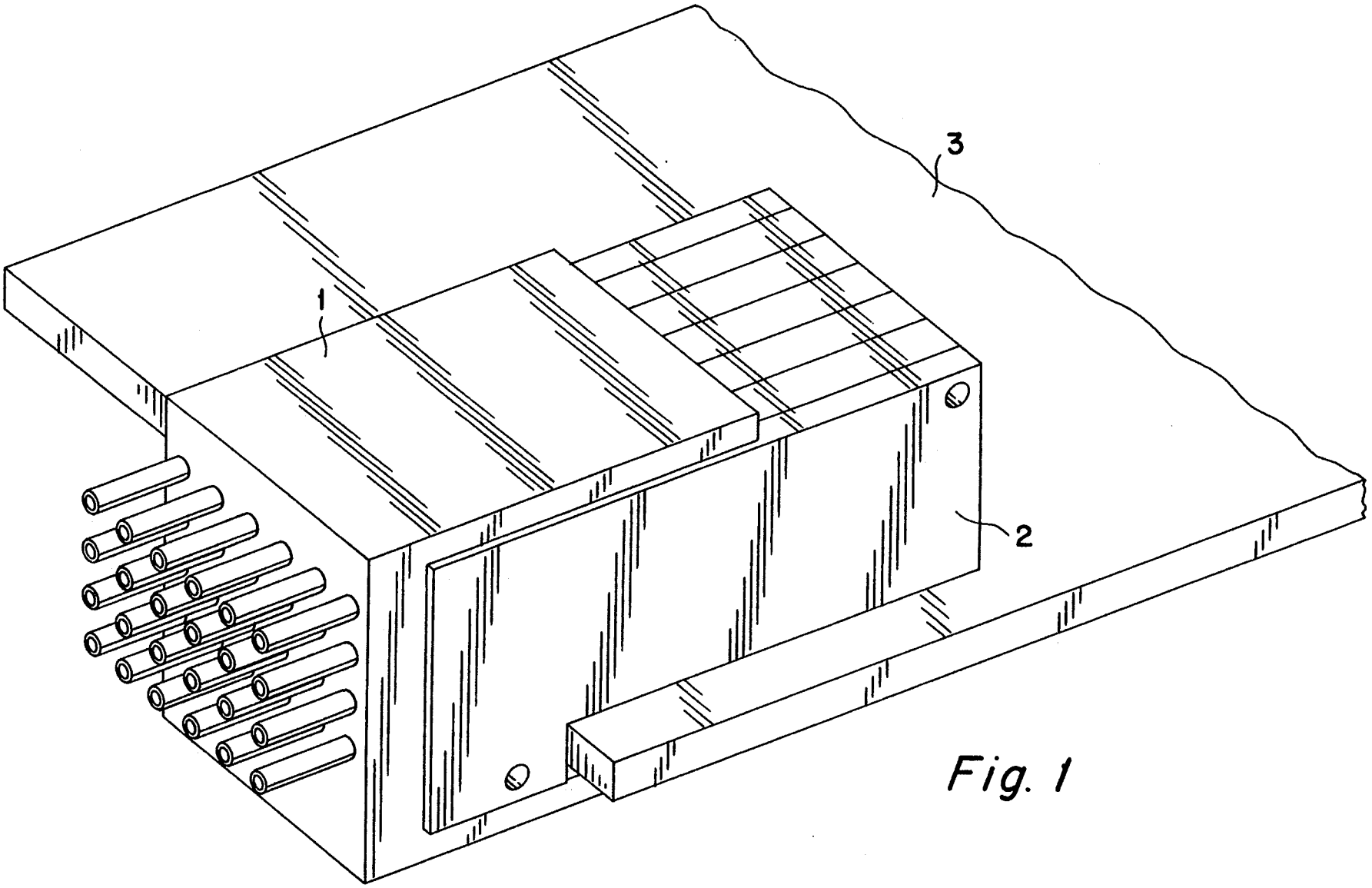
FIG. 1 is a perspective view of a first embodiment of the inventive connector and shows the connector in an assembled state.

FIG. 1 illustrates in perspective a first exemplifying embodiment of an inventive multipolar, screened connector. The connector comprises a male part 1 and a female part 2, which is mounted on and connected to a schematically illustrated printed circuit board or card 3.

Figure 2:
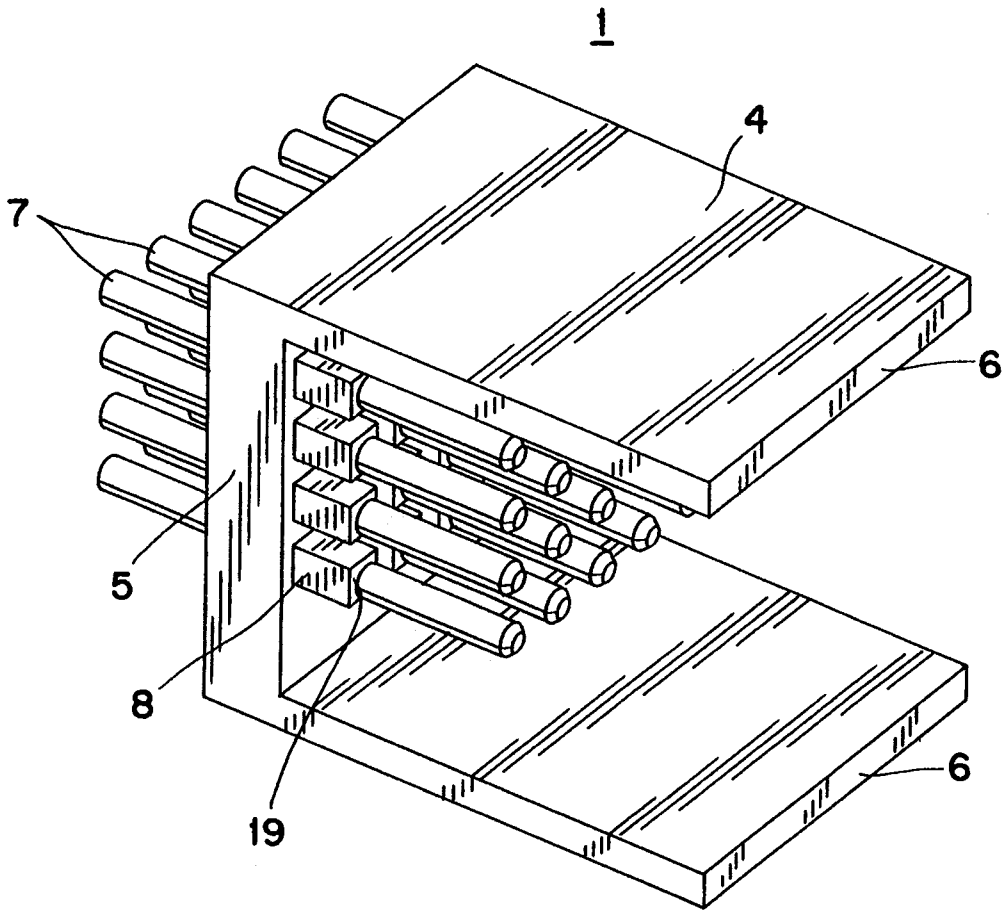
FIGS. 2 and 3 illustrate respectively the male part and the female part of the connector.

As will be seen more clearly from FIG. 2, the male part 1 comprises a substantially U-shaped body 4, which is made from an electrically insulating material. Disposed in rows and columns are a number of connector pins 7 which extend through the base part 5 of the body 4, parallel with the legs 6 surrounding the female part 2. In the case of the illustrated embodiment, the connector has four rows and six columns of pins, although it will be understood that the invention is not restricted to this particular number and that the connector may include fewer or more rows and columns respectively. The base part 5 is provided with projections 8, each of which encircles a respective pin 7 projecting out between the legs 6, these projections forming, together with corresponding recesses or cavities in the female part 2, wave traps against crosstalk of the high frequency signals.

Figure 3:
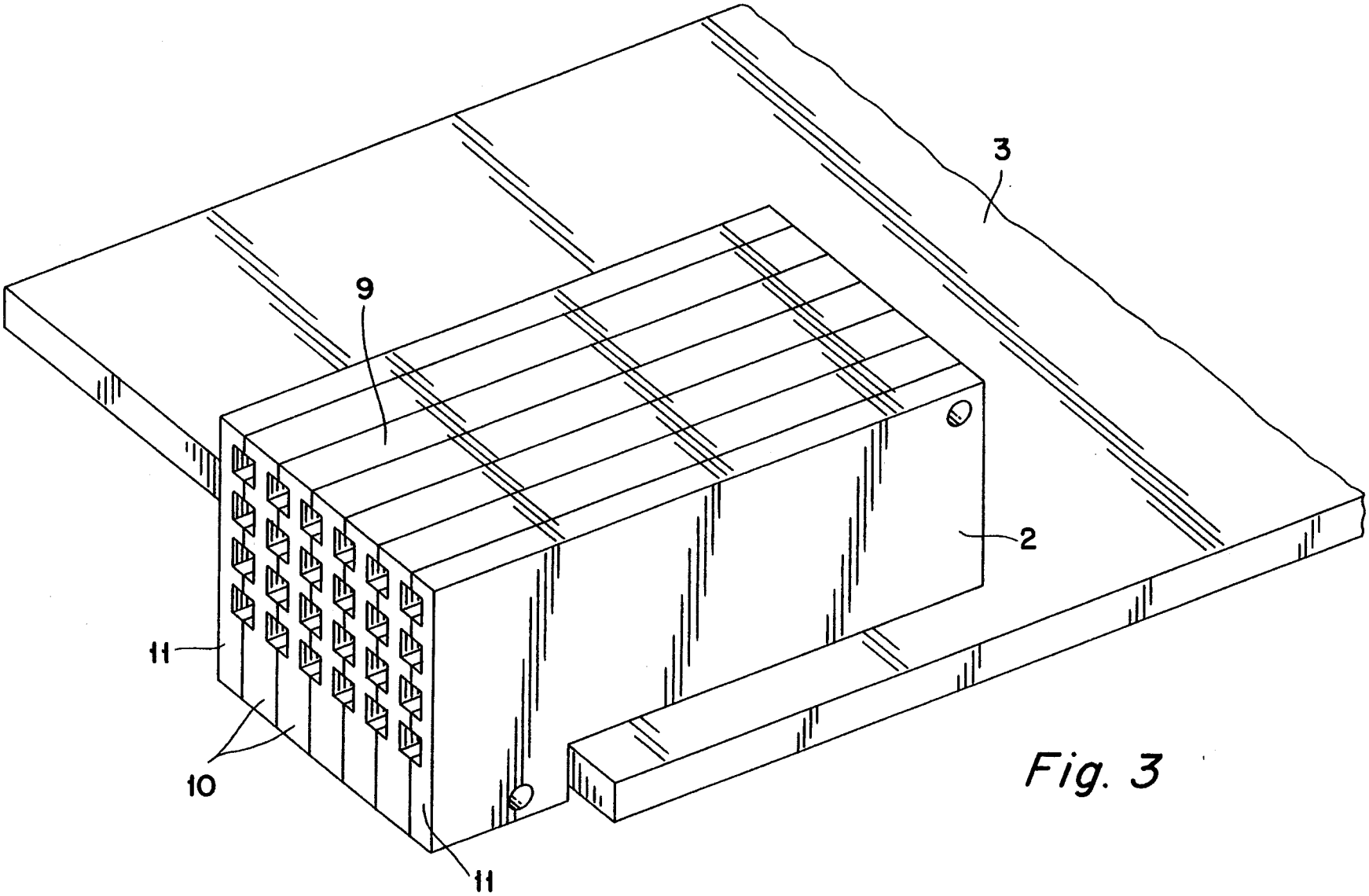

The female part 2 is shown more clearly in FIG. 3. As will be seen, the female part includes a body 9 which is made of an electrically insulating material and which is adapted to the male-part of the body 4 located between the legs 6 embracing said body. The body 9 is constructed of intermediate plates 10, in accordance with FIG. 4, and end plates 11, in accordance with FIG. 5. The plates 10 and 11 are adapted so that each dividing plane between the plates will correspond to a column of pins 7 in the male part 1. In the case of the illustrated embodiment, the female part 2 will thus include five intermediate plates 10 and two end plates 11.

Figure 4:
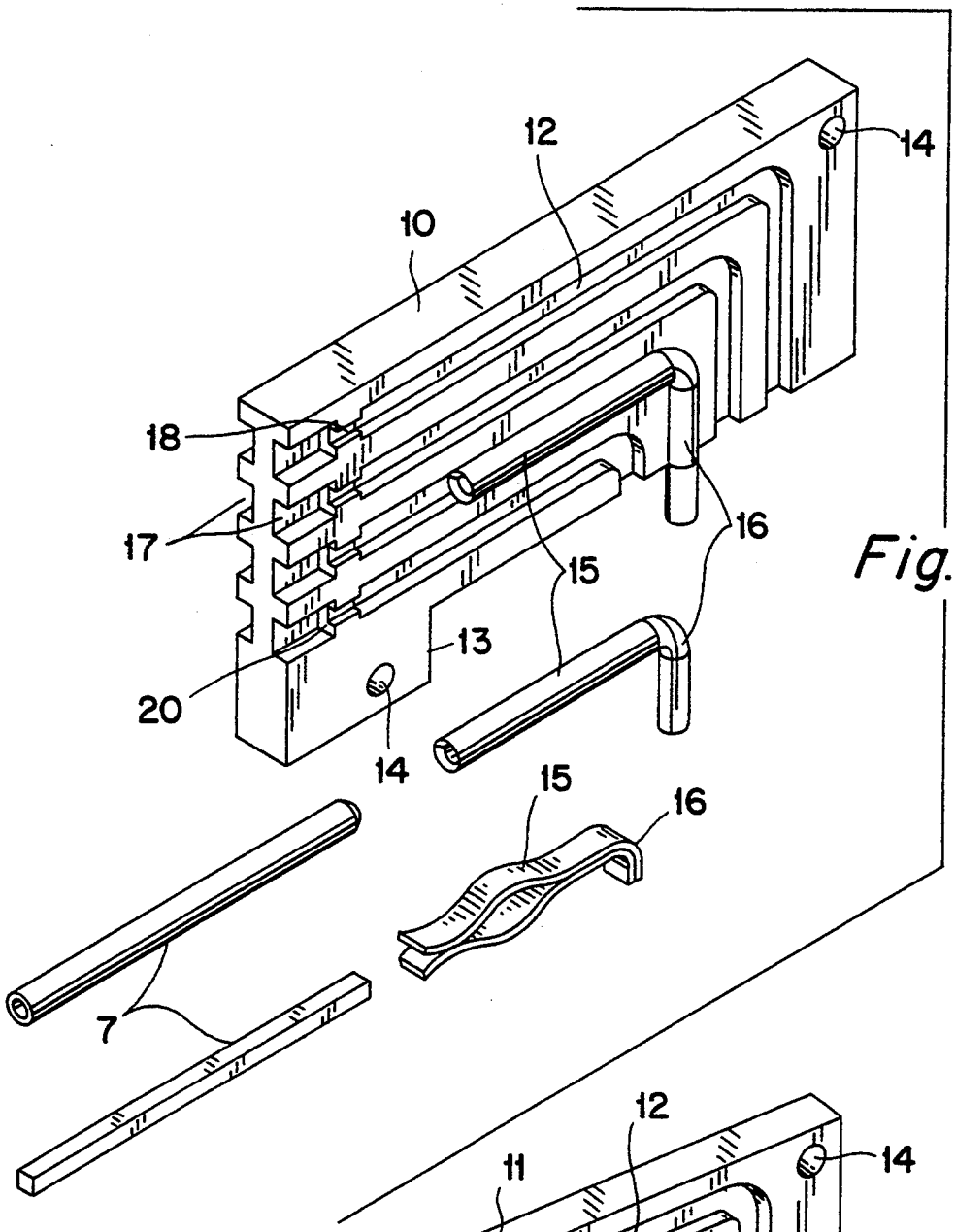
FIGS. 4 and 5 illustrate in perspective various plates forming part of the female part.
Figure 5:
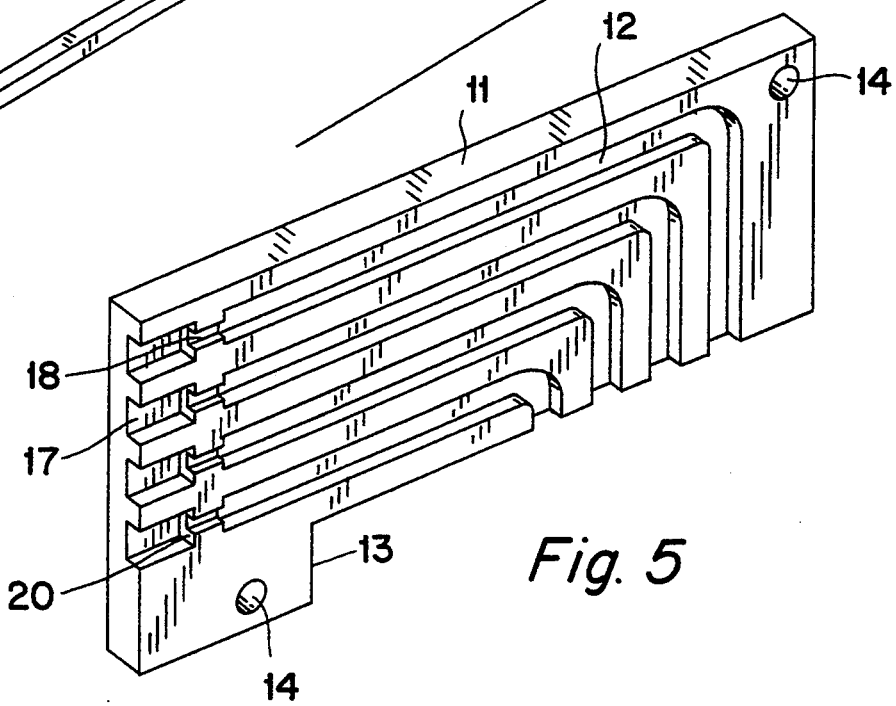

FIGS. 4 and 5 illustrate respectively the construction of the plates 10 and 11. The plates are provided in a mutually similar fashion with recesses 12, with the exception that the end plates 11 have recesses only on one side surface thereof, whereas the intermediate plates 10 have corresponding recesses on both side surfaces, as shown in the Figures. The two requisite end plates 11 are mirror images of each other. In the case of the illustrated embodiment, the plates 10 and 11 are also provided with shoulders or abutments 13 which abut the printed circuit card 3 on which the female part is to be mounted. The plates are also provided with through-passing holes 14 by means of which the plates can be screwed or bolted together, or joined by some other means, to form the female body-part 9.

The recesses 12 extend from that side of the plates 10 and 11 which faces towards the male part 1, initially in the direction of the pins 7, whereafter the recesses curve downwards towards that side of the female part 2 which faces towards the printed circuit card 3. When the plates 10 and 11 are assembled to form the female part 2, the mutually facing and abutting recesses 12 form channels for receiving contact devices 15 and contact lines or conductors 16, of which only one contact device and one contact line has been shown in position in the intermediate plate 10, although one further contact device and one further contact line, together with two variants of corresponding pins 7 have been drawn outside the plate in FIG. 4, for the sake of illustration. The recesses 12 are configured so that in the part 17 facing towards the male part 1 they will correspond to the projections 8, therewith forming together the aforesaid wave traps against crosstalk of the high frequency signals. At a location adjacent the part 17, the recesses 12 are provided with a narrower part 18 which corresponds to the connector pins 7 in the male connector-part.

Figure 6:
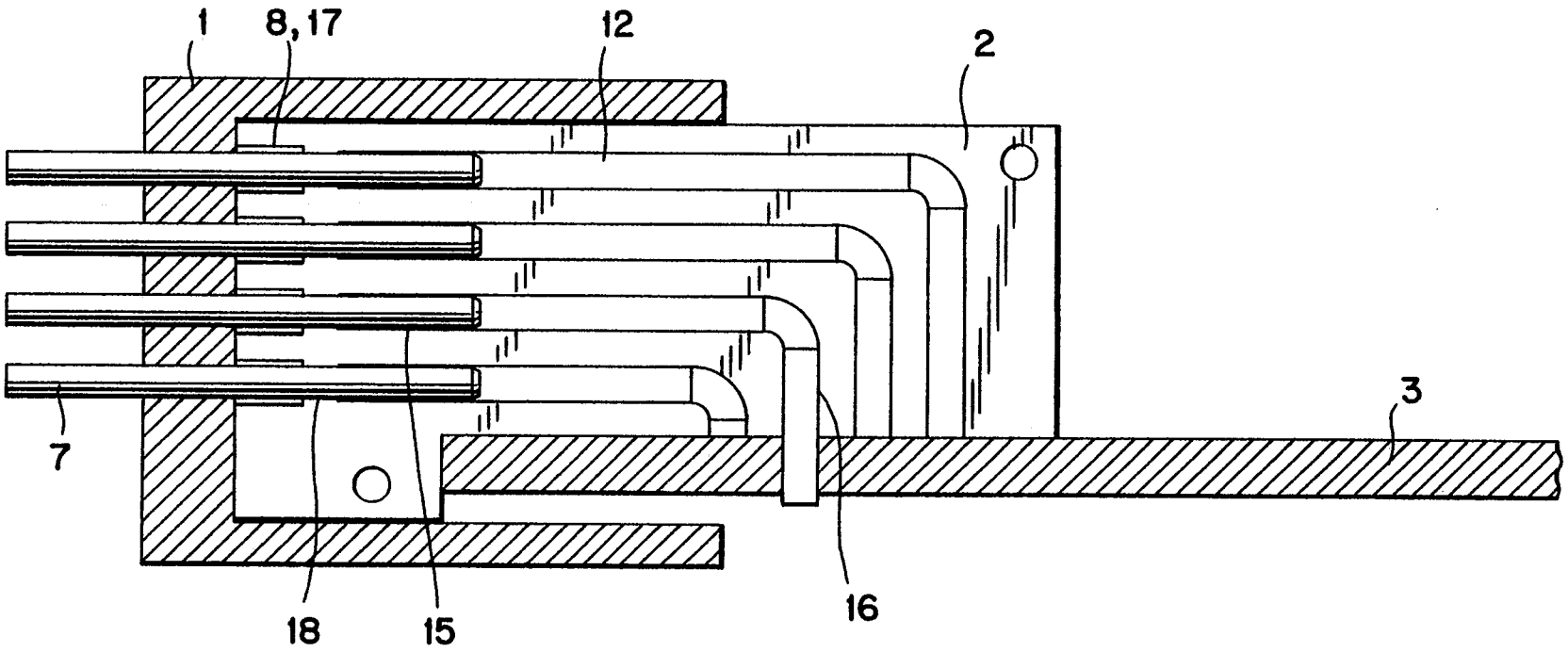
FIG. 6 is a sectional view through the assembled connector.

In order to screen the connector, the surfaces of both the male part 1 and the female part 2 are metallized, with the exception of the surfaces 19 on the projections 8 around respective pins 7 in the male connector-part 1, and also with respect to the surfaces of the recesses 12 from the location of the abutment surface 20 between the part 17 and the narrower part 18. The part 17 is thus also metallized. The plates 10 and 11 of the female part 2 are mutually connected electrically and, as a result of the metallization, the female part will be fully screened against external disturbances. As a result of this metallization, the pins and the contact lines are completely screened from the outer environment. The female part 2 is also connected to an earth plane located outermost on the printed circuit card 3, through the metallized surfaces of the plates 10 and 11 in the female connector-part 2. Contact between the male part 1 and the female part 2 is made directly in the earth plane, in that the metallized surfaces on the base part 5 and on the inwardly facing sides of the legs 6 of the male part slide against corresponding surfaces on the female body-part 9, as clearly shown in FIG. 6. For the sake of illustration, only one contact device and one contact line has been drawn in place in the female part illustrated in FIG. 6, said Figure illustrating how electrical contact is established between the pins 7 and the contact devices 15 and how the contact lines or conductors 16 are connected to the printed circuit card 3. In order to improve contact between the metallized surfaces of the various parts, and also between the plates 10 and 11 respectively, the surfaces are preferably embossed with small irregularities, so as to ensure that proper contact is achieved between said surfaces.

The conductors are screened against the outer environment in the junction between the parts by the projections 8 and corresponding parts 17 of the recesses 12, forming said wave traps, these surfaces being in electrical contact via the metallization. The earth plane located between the male part 1 and the female part 2 may also be connected electrically by making one or more of the pins 7 longer than the remaining pins, not shown in the drawings, so that when the parts are assembled, electrical contact will first be established between the contact devices 15 and the earth contact conductor 16 in the female part 2.

Figure 7:
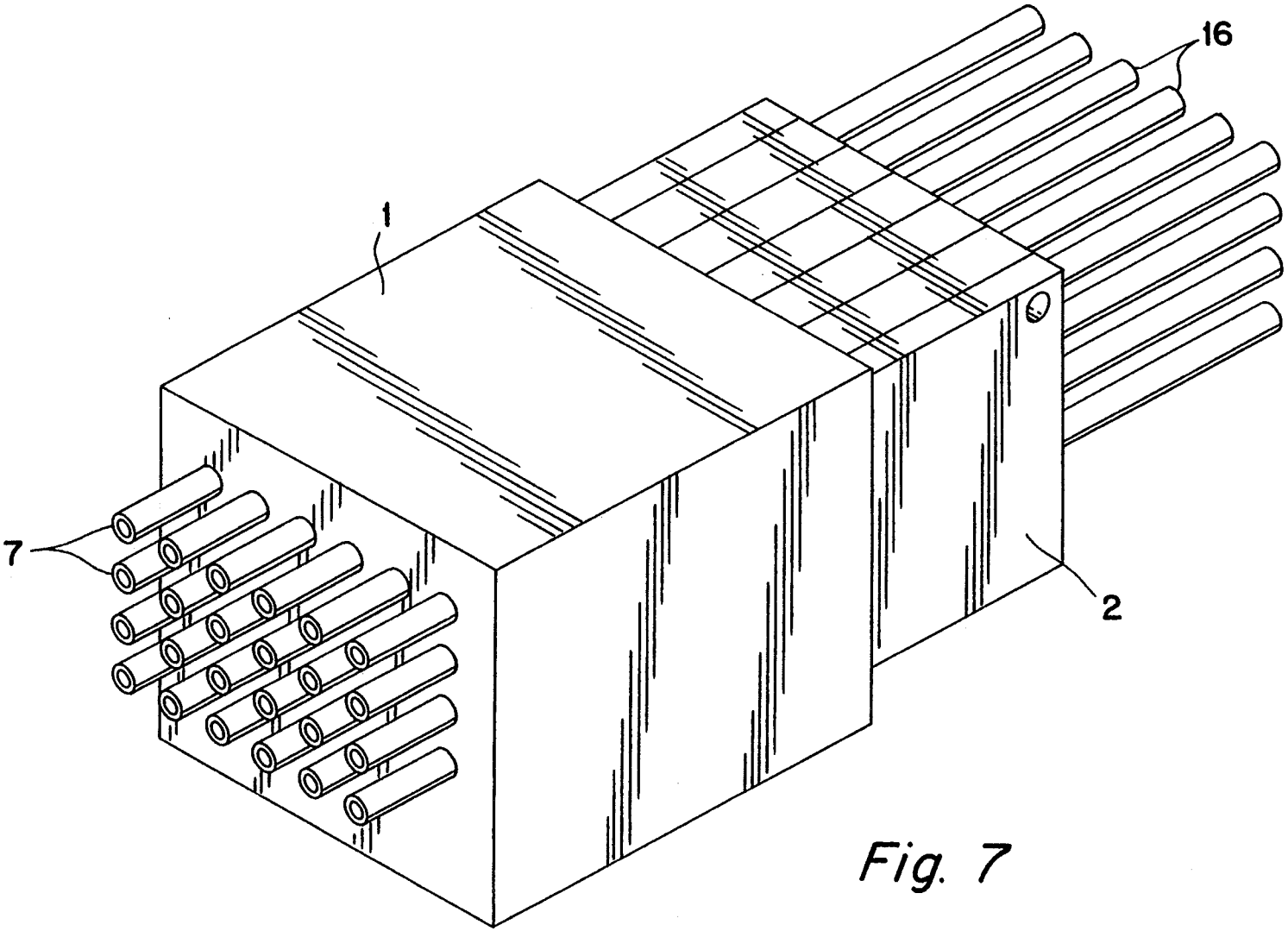
FIG. 7 is a perspective view of a second embodiment of the inventive connector and shows said connector in its assembled state.
Figure 8:
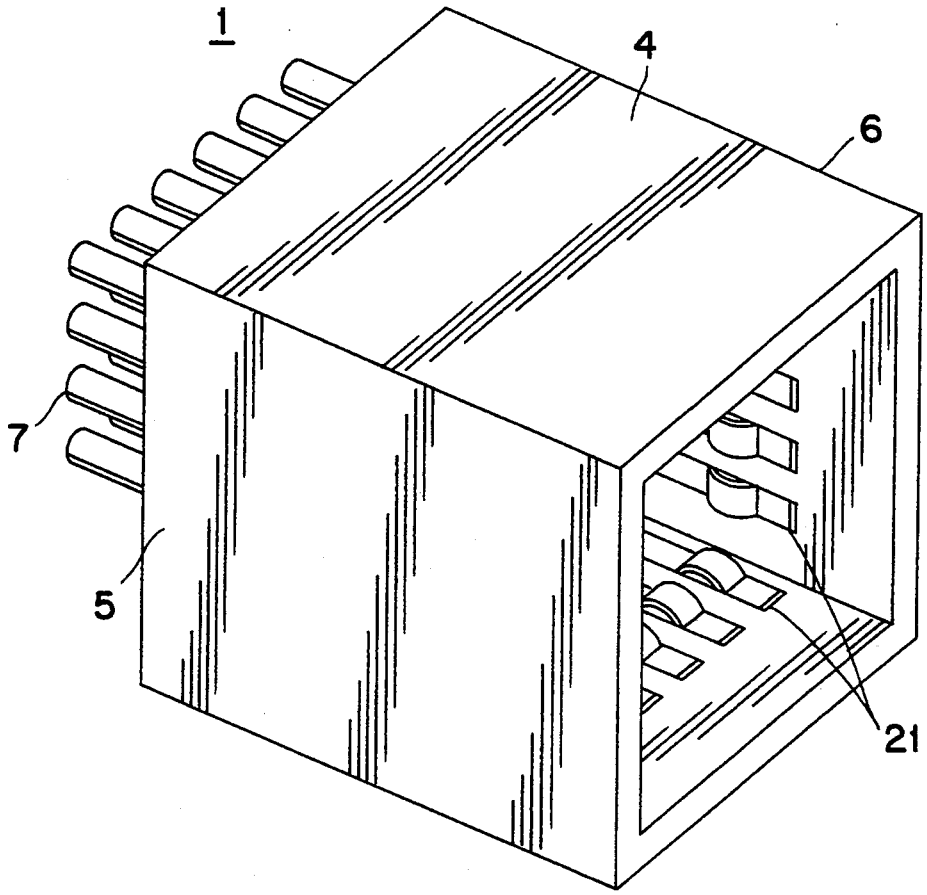
FIG. 8 illustrates the male part shown in FIG. 7.
Figure 9:
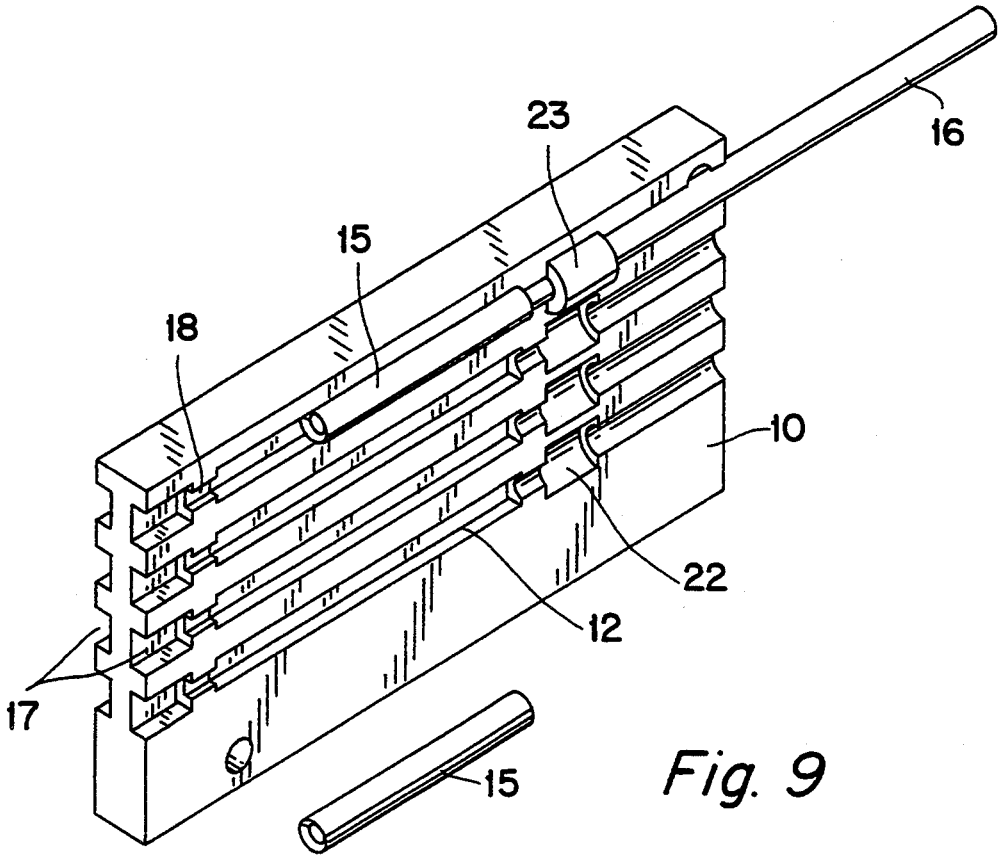
FIG. 9 illustrates in perspective a plate forming part of the female part illustrated in FIG. 7.

FIG. 7 illustrates another exemplifying embodiment of the inventive connector. As shown in FIG. 8, the male part 1 comprises a body 4 having a box-like part 6 which fully surrounds the female part 2. As in the case of the earlier described embodiment, the connector pins 7 extend through the base part 5 of the body 4 and into the space in the part 6, for contact with the female part. In order to obtain still better screening and electrical contact between the male and female parts, the inner surface of the surrounding part 6, i.e. the side surfaces facing towards the female part 2, are provided with resilient metal tongues 21 which make contact with the female part and form an improved screen around the connector. The construction of these metal tongues and their manner of attachment in the male part will be described in more detail below with reference to FIG. 10. In the case of this embodiment, the female part 2 is intended to form a contact part for a plurality of coaxial lines 16 and is constructed in the aforedescribed manner from intermediate plates 10 and end plates 11, of which one intermediate plate 10 is shown in FIG. 9. As with the earlier described embodiment, only one contact device 15 has been drawn in position in the Figure. The difference between this embodiment and the embodiment earlier described is that, in this case, the recesses 12 extend transversely across the plate and that an enlarged part 22 is formed in the recess. This enlarged part is also metallized. In the enlarged part 22, the screen of the coaxial line 16, said screen being exposed at its outer end, is clamped firmly by means of a metal sleeve 23 which embraces the coaxial line and makes contact with the enlarged part 22.

In another embodiment of an improved screen between the male and female parts, the male part 1 may be provided with an additional earth contact means in the form of a thin metal plate 24 which is provided with openings 25 corresponding to the projections 8. Tongues 26 have been punched from the material in the openings 25 and bent perpendicularly to the plane of the plate, so as to abut the projections and make contact with corresponding part 17 of the female part. The projections 8 are provided with corresponding recesses 27 for accommodation of the tongues 26, as shown in FIG. 10, this Figure showing the male part with plate 24 mounted thereon, and also the various components in an exploded view. For the sake of simplicity, only one plate is shown, although in reality four plates 24 would probably be required, each provided with tongues 26 punched-out along one side of the openings 25, since it is not possible to punch-out all four tongues from the material in one opening. The plates are mounted in the male part so that the tongues will abut all four sides of a respective projection 8.

The aforedescribed metal tongues 21 illustrated in FIG. 8 can be formed in a similar manner as the tongues 26, by punching-out metal plates provided with openings corresponding to the projections 8 and adapted to the base part 5 of the male part 1, wherewith the plate material remaining outside the corresponding base part is bent at right angles to the plane of the plate, to form the tongues 21. Thus, only one metal plate is required in this case.

It will be understood that the aforedescribed embodiments can be combined in various ways. For example, a male part 1 according to FIG. 2 can also be used with a female part 2 according to FIGS. 7 and 9, or the improved protection against crosstalk according to FIG. 10 and/ or the EMC-shield according to FIG. 8 can be used selectively in the different variants of the invention.

It will be understood that the invention is not restricted to the aforedescribed and illustrated embodiments thereof, and that modifications can be made within the scope of the following claims.

I claim:

1. A multipolar, screened connector having a common earth and comprising a male part and a female part, wherein the male part comprises a body which is made from an electrically insulating material and which has surrounding parts which are adapted to the female part and surround said female part at least partially, and wherein said body includes rows and columns of connector pins which extend through the base part of said body parallel with the surrounding parts, and wherein the female part includes a body which is made from an electrically insulating material and which is intended for insertion between the surrounding parts of the body of the male part and which is provided with hole parts which are adapted to receive the pins of the male part, and channels intended for contact lines which extend from said hole parts to contact devices connecting said pins, wherein the body of the female part is constructed from a plurality of plates having mutually facing sides and each plate defining a pitch which corresponds to the columns of pins; in that each of the mutually facing sides of the plates is provided with a recess which forms half of the hole parts corresponding to a column of pins and the channels for the contact lines; and in that outer defining surfaces of both the body of the male part and the plates of the female part are metallized with the exception of areas immediately around the pins and in the hole parts and the channels respectively.

2. A connector according to claim 1, wherein the male part is provided with projections which form wave traps and which encircle respective pins projecting between the surrounding parts; and in that the recesses in the plates of the female part are provided with corresponding parts, said projections and said parts also being metallized.

3. A connector according to claim 2, wherein metal plates having openings corresponding to the projections of said male part are arranged in abutment with the base part; in that the metal plates are provided with resilient tongues which are disposed around the openings and which extend perpendicularly to the plates; and in that the projections are provided with recesses corresponding to said tongues.

4. A connector according to claim 1, wherein the male part is provided with a part which fully surrounds the female part; and in that the inwardly facing surface of said surrounding part is provided with resilient metal tongues which abut the plates of the female part in the assembled state of the connector.

5. A connector according to claim 1, wherein the body of the male part has a U-shape with the legs of said U extending parallel to the pins.

6. A connector according to claim 1, wherein the metallized surfaces are embossed.

7. A connector according to claim 1, wherein certain of the pins are longer than remaining pins, so as to form earth pins.

8. A connector according to claim 1, wherein the female part is intended to be mounted on a printed circuit card or the like and is provided with an abutment for abutment with one edge of the printed card.

9. A connector according to claim 1, wherein the contact lines are coaxial cables whose screen is secured and an electric contact established in a correspondingly enlarged part of respective recesses in the female part, by means of a surrounding sleeve.

10. A connector according to claim 1, wherein the plates of the female part are provided with mutually coincidental through-passing holes and are held together by means of bolts or like fasteners inserted through said holes.

11. A connector according to claim 2, wherein the male part is provided with a part which fully surrounds the female part; and in that the inwardly facing surface of said surrounding part is provided with resilient metal tongues which abut the plates of the female part in the assembled state of the connector.

12. A connector according to claim 3, wherein the male part is provided with a part which fully surrounds the female part; and in that the inwardly facing surface of said surrounding part is provided with resilient metal tongues which abut the plates of the female part in the assembled state of the connector.

13. A connector according to claim 2, wherein the body of the male part has a U-shape with the legs of said U extending parallel to the pins.

14. A connector according to claim 3, wherein the body of the male part has a U-shape with the legs of said U extending parallel to the pins.

15. A connector according to claim 2, wherein the metallized surfaces are embossed.

16. A connector according to claim 2, wherein certain of the pins are longer than remaining pins, so as to form earth pins.

17. A connector according to claim 2, wherein the female part is intended to be mounted on a printed circuit card or the like and is provided with an abutment for abutment with one edge of the printed card.

18. A connector according to claim 2, wherein the contact lines are coaxial cables whose screen is secured and an electric contact established in a correspondingly enlarged part of respective recesses in the female part, by means of a surrounding sleeve.

19. A connector according to claim 2, wherein the plates of the female part are provided with mutually coincidental through-passing holes and are held together by means of bolts or the like fasteners inserted through said holes.

20. A connector according to claim 3, wherein certain of the pins are longer than remaining pins, so as to form earth pins.

* * * * *